United States Patent [19]

Box

[11] Patent Number: 4,757,910

[45] Date of Patent: Jul. 19, 1988

[54] EDGE ATTACHMENT MEANS FOR BEVERAGE CASES

[75] Inventor: Thomas Box, Tinton Falls, N.J.

[73] Assignee: Spectrum International, Inc., Shrewsbury, N.J.

[21] Appl. No.: 65,892

[22] Filed: Jun. 21, 1987

[51] Int. Cl.[4] ..... B65D 1/24

[52] U.S. Cl. ..... 220/71; 206/503; 206/511

[58] Field of Search ..... 220/71, 23.6, 71; 206/427, 503, 509, 511, 512; 200/503, 511

[56] References Cited

U.S. PATENT DOCUMENTS

| | | | |
|---|---|---|---|
| 3,628,684 | 12/1971 | Sere | 206/427 X |
| 3,997,055 | 12/1976 | Box | 206/427 |
| 4,197,958 | 4/1980 | Zeni et al. | 206/503 X |
| 4,320,845 | 3/1982 | Waller | 206/511 X |
| 4,548,320 | 10/1985 | Box | 206/427 X |

*Primary Examiner*—Steven M. Pollard

*Attorney, Agent, or Firm*—Hedman, Gibson, Costigan & Hoare

[57] ABSTRACT

A beverage case with mating tapered top and bottom edges is provided. Slots and extensions in registry with the slots to afford positive fitting of stacked cases are also provided.

4 Claims, 3 Drawing Sheets

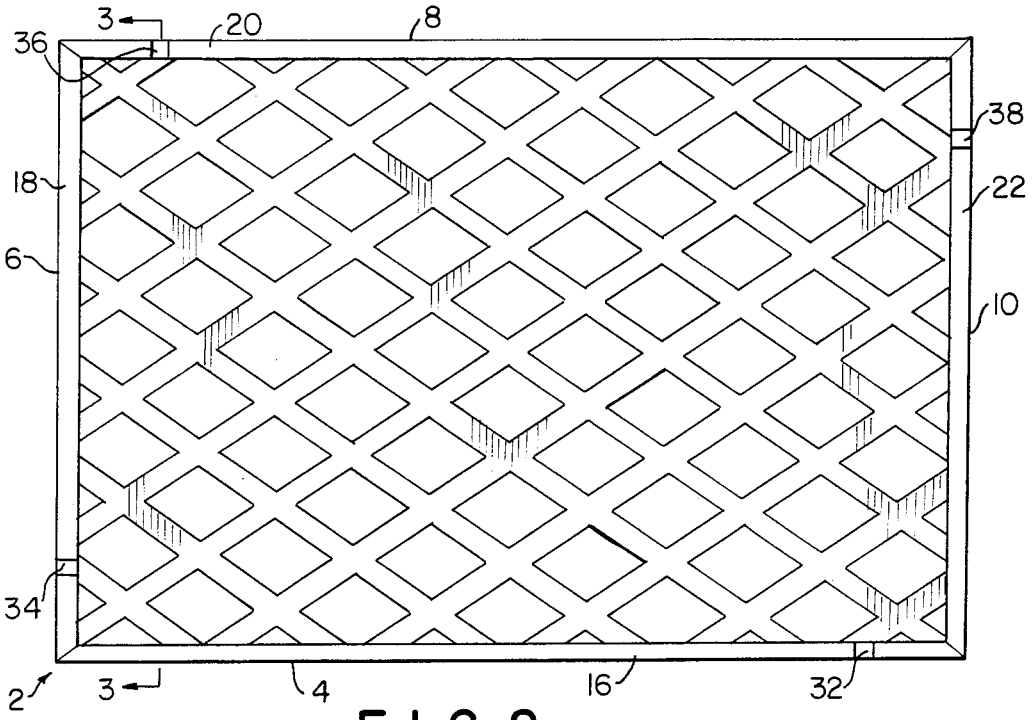
FIG. 2
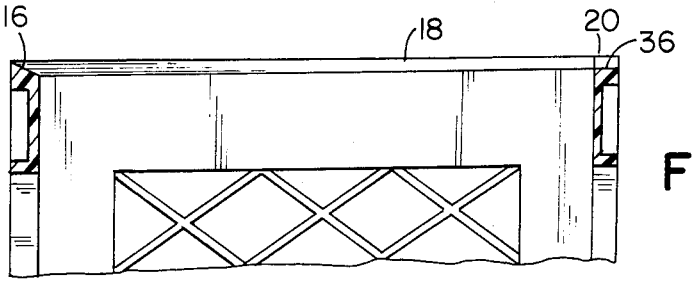
FIG. 3
FIG.4
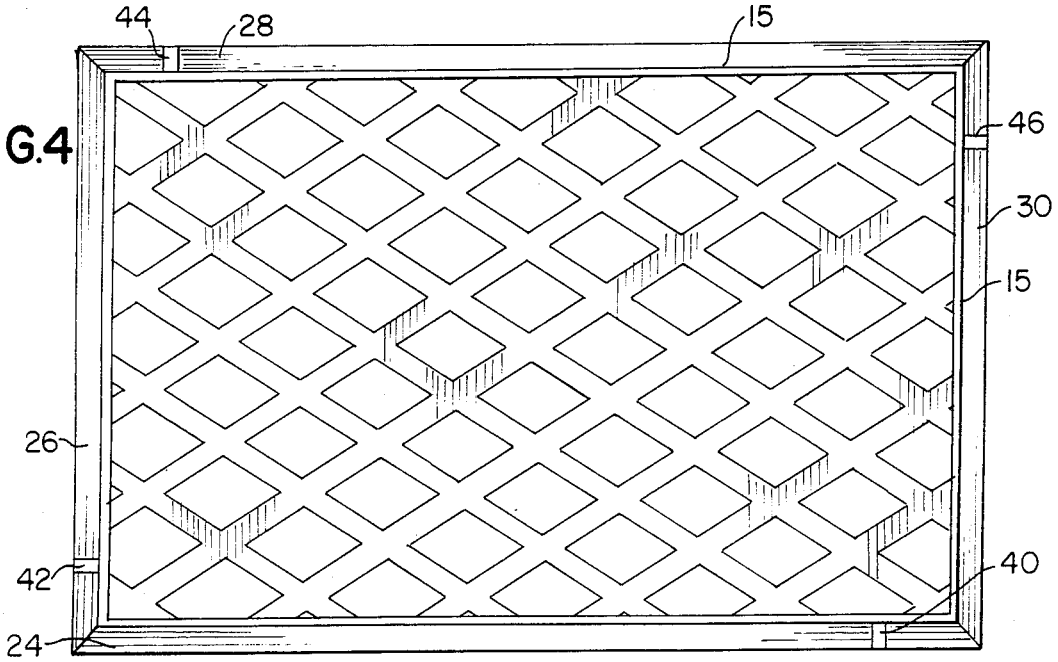

EDGE ATTACHMENT MEANS FOR BEVERAGE CASES

FIELD OF THE INVENTION

This invention relates to beverage cases for accommodating cartons of milk or similar items during transfer and on-site storage. More particularly, the invention relates to a means for positively securing a plurality of beverage cases together during long distance transfer and on-site handling.

BACKGROUND OF THE INVENTION

For some time plastic beverage cases dimensioned to accommodate a plurality of beverage containers such as milk cartons have been used beneficially to transport and store the beverage containers. The milk cartons stored in the beverage cases are generally of the conventional sizes; i.e. pint, quart, half-gallon. Typically, an array of cartons such as nine half-gallon cartons fit neatly in a container with sufficient allowance to afford insertion and removal of the individual cartons without damage to the cartons or inconvenience to a person removing the carton.

The beverage cases are designed to be stacked, especially during shipment when a maximum amount of milk cartons are intended to be transported in a minimum amount of space. Thus, when the beverage cases are full and stacked three, four or five high, a column of considerable weight is established. Typically, the beverage cases are provided with a continuous inner rim that depends downwardly from the case at a location inwardly from the periphery of the case. The rim is sized to fit inside the inner edge of the top of another case and depends downwardly from the bottom of each case about one-fourth to three-eighth inches. Practice has taught that any greater depth of the rim causes difficulty in manually separating the beverage cases.

The current practice of moving a column of beverage cases from a location, such as an inventory storage area to a point of sale display location, is to manually remove each beverage case individually from the column and restack the beverage cases.

Recently, efforts have been made to move the beverage cases either individually or in stacked columns by sliding the beverage cases over a floor surface. The beverage cases are provided with gripping structures adapted to receive a hook. The hook is attached to the beverage case gripping surface, usually a beverage case handle, and force is exerted to move the beverage case across a floor surface. During travel of a column of beverage cases, the hook is attached to a handle of the bottom beverage case of the column and pulled across a floor. The handler usually uses one hand to pull the hook and the other to steady the column by holding the handle of one of the upper cases in the column. Typically, a slight tilting of the column occurs and the column is dragged across the floor on the near edge of the rim at the bottom of the bottom beverage case. A less than totally stable condition results. Further, wear of the case rim from continual use produces a condition wherein even less positive connection between the cases exists.

Generally, the weight of the full cartons provide a vertical force on the respective beverage cases comprising a column of beverage cases. However, when sudden forces are applied to move the column, there is a tendency for the beverage cases to separate. Further, when moving the empty stacked beverage case, the vertical connecting force imposed by the full cartons is absent. Thus, the tendency of the beverage cases to separate is much greater.

SUMMARY OF THE INVENTION

An object of the present invention is to provide means to releasably secure stacked carton beverage cases to each other.

A further object of the invention is to provide means to assist in maintaining a column of stacked beverage cases in vertical alingment when a horizontal force is imposed on the column to move the column.

Thus, conventional beverage cases are provided with mating inclined edge surfaces. An edge or all four edges of the upper surface of the carton beverage cases are provided with an inclined surface either extending upwardly or downwardly from an inward location. The respective opposing edges on the bottom of the beverage case are provided with inclined surfaces that incline oppositely of the incline of the upper surface inclined edges to mate with the inclined upper surfaces of the beverage cases. In addition, the upper surface of each container is provided with a slot or recess disposed above a vertical rib on each of the four sides of the beverage case. The lower surface is provided with an extension on each of the four sides located at the bottom of the vertical ribs aligned with and sized to fit into the slots on the lower surface of the beverage case. The extensions are located below the vertical ribs and, in effect, become a part of the rib.

DESCRIPTION OF THE DRAWINGS

The invention will be better understood when considered with the following drawings wherein:

FIG. 2 is a plan view of the beverage case of FIG. 1 through line 2—2 of FIG. 1;

FIG. 3 is a side elevational view of the beverage case of FIG. 1 through line 3—3 of FIG. 1;

FIG. 4 is an upward plan view of the beverage case of FIG. 1 through line 4—4 of FIG. 1;

DESCRIPTION OF THE PREFERRED EMBODIMENT

The present invention is described herein associated with an essentially conventional beverage case for accommodating milk cartons. However, it should be understood that the conventional beverage case has been structured to accept the invention and that the invention has application with any beverage case having upper and lower edge surfaces adapted to facilitate vertical stacking of the beverage cases.

Figure 1:
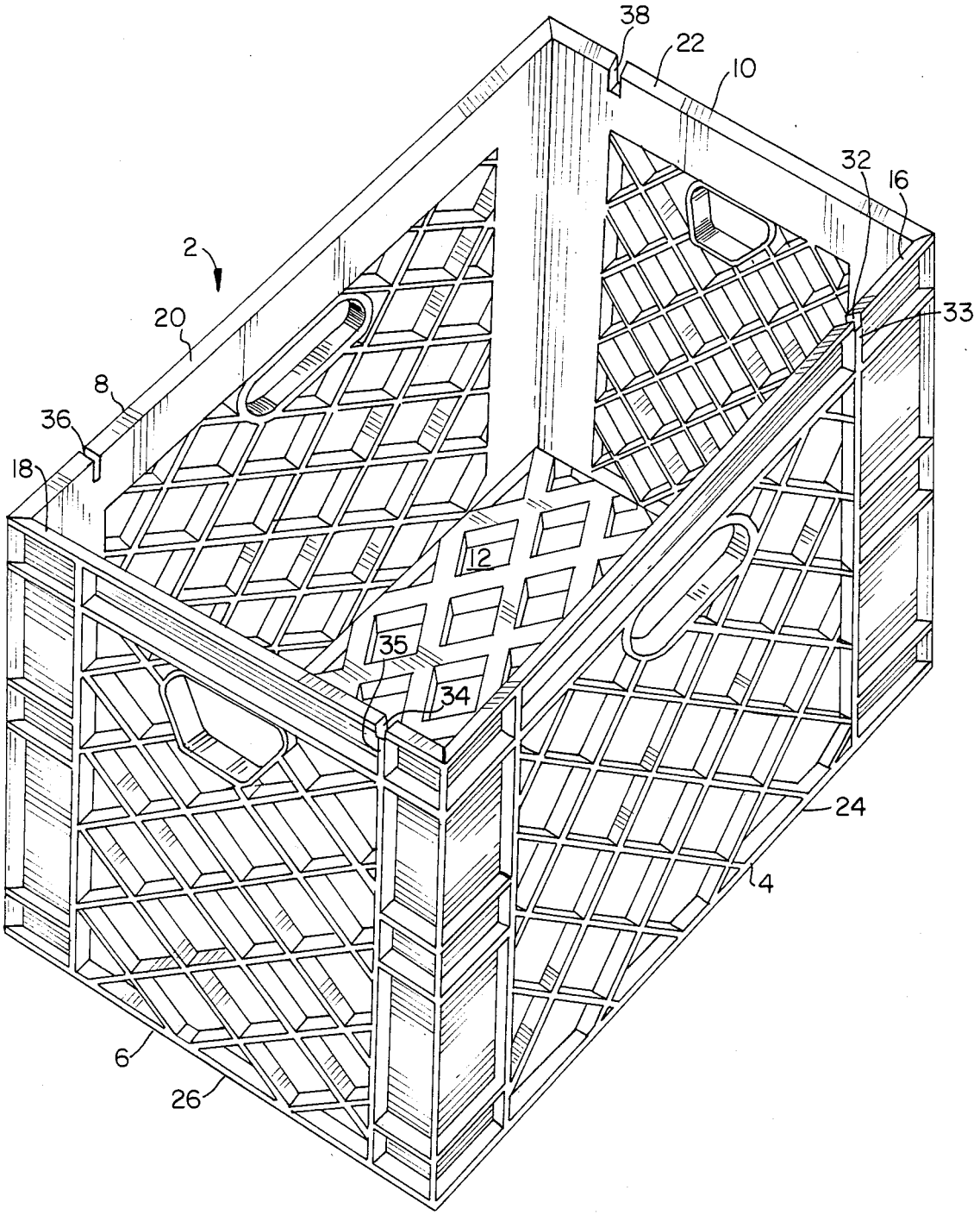
FIG. 1 is a perspective view of a beverage case provided with the present invention.
Figure 5:
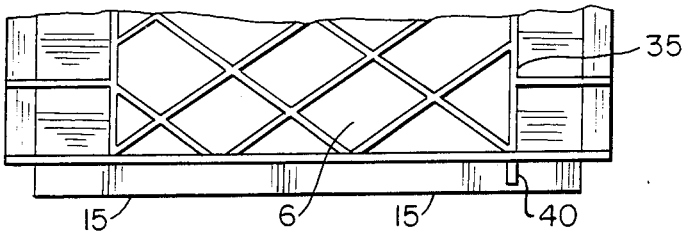
FIG. 5 is a side elevational view of the beverage case of FIG. 1 through line 5—5 of FIG. 1.

As seen in FIG. 1, a conventional beverage case 2 is shown comprised of sides 4, 6, 8 and 10, a bottom 12 and a handle opening 14 for manually transferring the beverage cases and for recieving a hook (not shown). In addition, the bottom of the beverage case, best seen in FIG. 4, is provided with a continuous stacking rim 15 located within the periphery of the beverage case to fit within the inner edge of the top of a mating beverage case.

Each side 4, 6, 8 and 10 has a respective upper surface or top edge 16, 18, 20 and 22 and a lower surface 24, 26, 28 and 30.

As best seen in FIGS. 2 and 3, each upper surface or top edge 16, 18, 20 and 22 is upwardly inclined from the inside of the beverage case to the outside at an angle of 25° to 35° and preferably about 30° . In addition, each upper edge surface 16, 18, 20 and 22 is provided respectively with a slot 32, 34, 36 and 38. The slots 32, 34, 36 and 38 are aligned with vertical ribs 33, 35, 37 and 39 that are formed respectively in the sides 4, 6, 8 and 10. Each lower or bottom edge surface 24, 26, 28 and 30 is inclined upwardly from the inside of the beverage case to the outside at an angle to mate with the angle of the top edges 16, 18, 20 and 22; i.e. 25° to 35° and preferably 30° . In addition, each bottom surface 24, 26, 28 and 30 is provided respectively with an extension 40, 42, 44 and 46. Each extension is aligned with and extends from the vertical ribs 33, 35, 37 and 39.

The extensions 40, 42, 44 and 46 are aligned with the slots 32, 34, 36 and 38 to enable the extension to fit into the slots when the beverage cases 2 are stacked in a column.

The typical material for beverage cases is polypropylene, polyethylene or a similar plastic. Thus, the extensions are sized to avoid the development of stress concentrations at the angle to the edge of the surface on which each extension is mounted.

Figure 7:
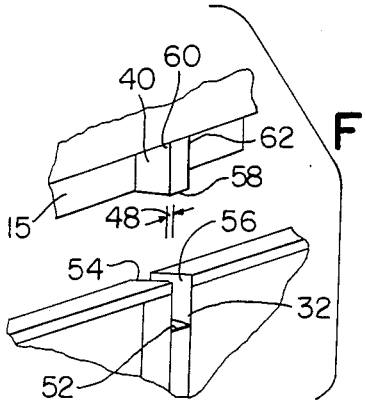
FIG. 7 is an exploded view of the connection of FIG. 6.

As best seen in FIG. 7, it has been found that slots 32, 34, 36 and 38 having dimensions essentially the same as the ribs 33, 35, 37 and 39; i.e., a $\frac{1}{8}$ inch to $\frac{3}{8}$ width (preferably 174 inch); a depth which is the wall thickness of the crate of $\frac{3}{8}\times\frac{5}{8}$ (preferably $\frac{1}{2}$ inch) and a $\frac{1}{8}$ to $\frac{3}{8}$ length (preferably $\frac{1}{4}$ inch) are well suited to the practice of this invention. The slots 32, 34, 36 and 38 each have three surfaces, a horizontal bottom surface 52 and vertical sides 54 and 56. Extensions 40, 42, 44 and 46 having mating dimensions essentially the same as the slots 32, 34, 36 and 38 are thus used. Each extension is comprised of three surfaces, a horizontal top surface 58 and vertical sides 60 and 62. It has also been found that allowance areas 48 best seen in FIG. 7 of 1/32 inch on each side between the slot walls 54, 56 and the respective adjacent extension walls 60 and 62 are very desirable to facilitate close fitting entry of the extensions into the slots.

Figure 6:
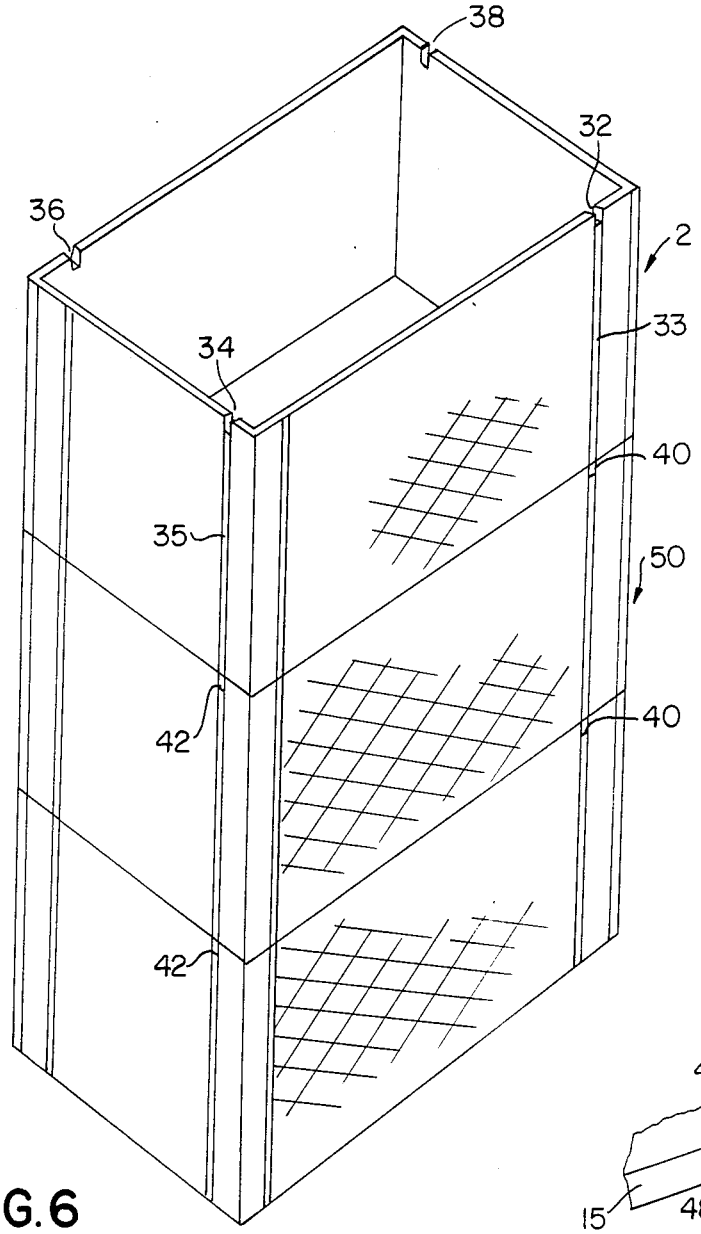
FIG. 6 is a stacked column of beverage cases provided with the present invention.

As seen in FIG. 6, a column 50 of empty carton beverage cases 2 is shown with the mating inclined edges in contact and the extensions inserted in the slots. The column 50 is now capable of being moved in a horizontal direction rapidly without dislodgement of the beverage case from the column 2.

Movement of the column 50 of either empty or full beverage cases 2 can be achieved by inserting a hook into a handle opening 14 of the beverage case 2 at the bottom of the column 50 and pulling the entire column across a floor surface. A column of beverage cases five high filled with milk quarts weighs about two hundred and sixty pounds. A five high column of empty beverage cases weighs about twenty pounds.

Figure 8:
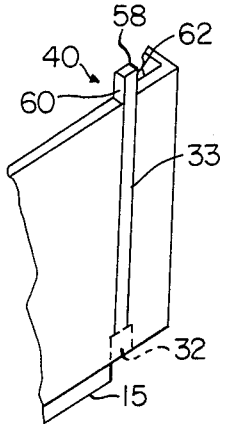
FIG. 8 is a view of the embodiment with the slots on the bottom surface and the extensions at the top.

As seen in FIG. 8, the beverage case 2 of the present invention is provided with the extensions 40, 42, 44 and 46 at the top and the slots 32, 34, 36 and 38 at the bottom. In this embodiment, the extensions are not exposed to any hazzards that might be present when dragging a beverage case across a floor on the bottom rim 15.

I claim:

1. A stackable beverage case having four vertical sides;

an inclined upper edge continuous about the four sides;

a continuous bottom edge inclined oppositely to the continuous upper edge;

a rib structure formed on the exterior of the beverage case comprising four vertical reinforcement ribs extending from the upper edge to the bottom edge; and a slot disposed on each of said four sides along the continuous upper edge in alignment with each of said vertical reinforcing ribs and extensions of each of said vertical reinforcing ribs disposed on each of said four sides of the bottom continuous edge in alignment with and extending from each respective vertical reinforcing rib.

2. A beverage case as in claim 1 further comprising a stacking rim on the bottom of the case.

3. A stackable beverage case as in claim 1 wherein the inclined top edge and inclined bottom edge incline at an angle of 25° to 30°.

4. A stackable beverage case as in claim 3 wherein said slots and said extension are $\frac{1}{4}$ inches in length; $\frac{1}{2}$ inches in width; $\frac{1}{4}$ inches in depth and an allowance opening between the slot walls and extension walls are provided.

* * * * *